United States Patent [19]

Hutchins

[11] Patent Number: 4,475,110

[45] Date of Patent: Oct. 2, 1984

[54] BEARING STRUCTURE FOR ANTENNA

[75] Inventor: Samuel F. Hutchins, Lilburn, Ga.

[73] Assignee: Scientific-Atlanta, Inc., Atlanta, Ga.

[21] Appl. No.: 339,124

[22] Filed: Jan. 13, 1982

[51] Int. Cl.[3] ..... H01Q 3/02

[52] U.S. Cl. ..... 343/766; 343/882

[58] Field of Search ..... 343/766, 840, 882; 384/282

[56] References Cited

U.S. PATENT DOCUMENTS

| | | | |
|---|---|---|---|
| 2,530,098 | 11/1950 | Van Atta | 343/766 |
| 2,604,593 | 7/1952 | Trowbridge | 343/882 |
| 2,605,417 | 7/1952 | Andrews | 343/758 |
| 2,883,665 | 2/1959 | Maratzke et al. | 343/878 |
| 3,146,452 | 8/1964 | Rose | 343/758 |
| 3,158,866 | 11/1964 | Powers | 343/882 |
| 3,711,166 | 1/1973 | Wayson | 384/282 |

OTHER PUBLICATIONS

"Voss V-Retainer Coupling Applications", Brochure of Voss Industries, Inc., (6 pp.).

"Voss V-Retainer Coupling Selection Guide", Bulletin No. 1275 of Voss Industries, Inc., (6 pp.).

"Aeroquip-Marman Industrial Products" Catalog 864 of Aeroquip Corporation, 1975, (42 pp.).

*Primary Examiner*—Eli Lieberman

*Attorney, Agent, or Firm*—Jones & Askew

[57] ABSTRACT

A lockable bearing apparatus for permitting rotation of adjacent members such as parts of an antenna mounting structure, wherein the adjacent members define circular bearing flanges surrounded and received by a coupling that can be tightened or loosened to lock or release the adjacent members. The coupling comprises an annular member defining an annular inwardly opening recess for receiving the flanges, and the flanges engage one another and are angled with respect to one another such that the coupling engages the flanges and urges them axially toward one another when the coupling is tightened. Stabilizing means for maintaining orientation of the adjacent members during rotation is disclosed, as well as means for selectively rotating the adjacent members with respect to one another. In the preferred embodiment for providing an azimuth axis in an antenna mounting structure, inexpensive sheet metal components are connected by the bearing apparatus embodying the invention.

12 Claims, 10 Drawing Figures

74
11
70
67
63
60
58
72
51
71
52
65
18
16
14
17
15
48
61
68
46
74
64
55
59
53
49
50
25
54
20
10
21
30
31
12
13

BEARING STRUCTURE FOR ANTENNA

TECHNICAL FIELD

The present invention relates to bearing structures for facilitating rotational movement between adjacent members, and more particularly relates to a bearing assembly for selectively permitting rotation of an antenna reflector about an axis.

BACKGROUND ART

In the field of satellite communications, a growing need has arisen for earth station antennas that are inexpensive to construct and easy to operate in order to change the orientation of the reflector to aim at any one of a number of geosynchronous satellites. In order to permit changes in its orientation, an antenna reflector must pivot or rotate about one or more axes, depending on the type of mounting utilized.

One typical antenna mounting structure is the elevation-over-azimuth type, in which bearing structures must be provided for independent rotation about the vertical or azimuth axis and about the horizontal or elevation axis. The elevation axis assembly should allow the reflector to be pointed from slightly below the horizon to high above the horizon. The azimuth bearing assembly has utility proportional to the degree of rotation permitted; optimal utility is realized if the reflector can rotate 360° about the azimuth axis. Some typical azimuth bearings provide such flexibility, and some do not. For example, in a spindle-type azimuth mounting, the reflector is attached to a vertical rod rotatably mounted on bearings extending from a support structure. Rotation through 360° is not possible, because the reflector cannot swing past the mounting structure in typical installations. Also, the support structure must be relatively massive in order to provide stability.

Rotation through 360° and stability has been provided by another typical azimuth bearing system, in which the antenna reflector is mounted on a large circular bearing, such as a roller bearing 2–10 feet in diameter, and the bearing is carried in a circular race. Stability is gained by increasing the diameter of the circular bearing, which also steeply increases the cost of this type of azimuth bearing system.

The polar reflector mounting structure is a widely used alternative to the elevation-over-azimuth system. As a result of necessary positioning of the orbits of geosynchronous satellites on the equitorial plane, an antenna reflector can move from one satellite to another by rotation about a single axis slanted with respect to the horizon and oriented in the North-South plane. The azimuth position of such an antenna must be initially fixed to place the polar axis in the North-South plane, and therefore it is best to provide an azimuth bearing assembly to facilitate fine adjustment of the azimuth position after the base of the antenna mounting structure is secured to a foundation. An elevation assembly is required to permit additional precise adjustment of the slant of the polar axis.

In addition to permitting rotation of the antenna reflector, bearing assemblies associated with antenna mounting structures must have means for locking the position of the antenna about the various axes. The pointing accuracy of an antenna aimed at a satellite must be within about 0.1°–0.25°. Thus, convenient and accurate positioning of an antenna requires that the bearing assemblies be lockable without motion of the antenna during the locking procedure. As a result of the various requirements for an acceptable antenna mounting structure, such structures have generally been constructed of heavy duty materials, often including expensive precision bearings. As the demand for satellite antennas has increased, the need for an inexpensive mounting structure providing the required precision adjustments has become more acute.

SUMMARY OF THE INVENTION

The present invention comprises a novel lockable bearing apparatus that is particularly useful for antenna mounting structures because it provides strength and flexibility at low cost.

Generally described, the present invention provides, in an antenna mounting structure, a bearing apparatus for permitting rotation of the antenna about an axis, comprising a support means supporting the antenna, the support means including a support bearing projection and a circular support bearing flange extending radially outwardly from the end of the bearing projection; base means, stationary during rotation of the antenna about the axis, for supporting the support means, the base means comprising a base bearing projection and a circular base bearing flange extending radially outwardly from the end of the base bearing projection, the base bearing flange being substantially equal in diameter to the support bearing flange; and coupling means for clamping the support and base bearing flanges together simultaneously at a plurality of points evenly spaced about the circumference of the flanges. The coupling means preferably comprises an annular coupling member surrounding the support and base bearing flanges and defining an annular inwardly opening recess therein for receiving the flanges. The coupling recess and flanges are respectively shaped such that when the coupling means is tightened about the flanges, the initial action of the coupling means is to press the flanges together, thereby preventing misalignment of the flanges during the locking of the bearing apparatus. The configuration of a bearing structure embodying the present invention permits it to be constructed of lightweight, inexpensive materials such as sheet metal. For stabilization, the bearing structure includes, in the preferred embodiment, shaft means extending axially from the center of the support bearing projection toward the base bearing projection, and locator means attached to the base means and defining a bore therein for receiving the shaft means.

In an antenna mounting structure, a bearing structure embodying the present invention can be used for selectively permitting rotation about any axis of rotation needed to orient the antenna reflector, including the azimuth axis, the elevation axis, and the polar axis. Bearing structures as generally described above can be adapted alone or in pairs to provide stable bearing assemblies.

The concept of the present invention is not limited to antenna mounting structures, but also can be embodied in a bearing structure for permitting relative rotation about an axis between a pair of adjacent members, comprising radially outwardly extending circular flanges defined by each of the members, the flanges being positioned coaxially about the axis and adjacent to one another; annular coupling means surrounding the flanges and retaining the flanges adjacent to one another, the coupling defining an annular inwardly opening recess therein for receiving the flanges; and shaft means extending axially from the center of one of the members to be rotatably received within an axial bore defined by the other of the members, the shaft means and bore maintaining axial alignment of the members. Locking and releasing of the bearing can be accomplished by contracting or expanding the circumference of the coupling means, such as by dividing the coupling means into two parts, and attaching the ends of the parts together with bolts that can be tightened or loosened.

Thus, it is an object of the present invention to provide a novel and improved bearing structure.

It is a further object of the present invention to provide an inexpensive lockable bearing structure for antenna mounting systems.

It is a further object of the present invention to provide an improved bearing structure for antenna mounting systems which provides rotation of the antenna reflector about desired axes and the ability to precisely lock the antenna reflector in any required position.

It is a further object of the present invention to provide an improved bearing structure for antenna mounting systems which can be constructed of inexpensive materials and still provide stability and accuracy of adjustment.

Other objects, features and advantages of the present invention will become apparent upon reading the following detailed description of embodiments of the invention, when taken in the conjunction with the drawing and the appended claims.

DETAILED DESCRIPTION

Figure 1:
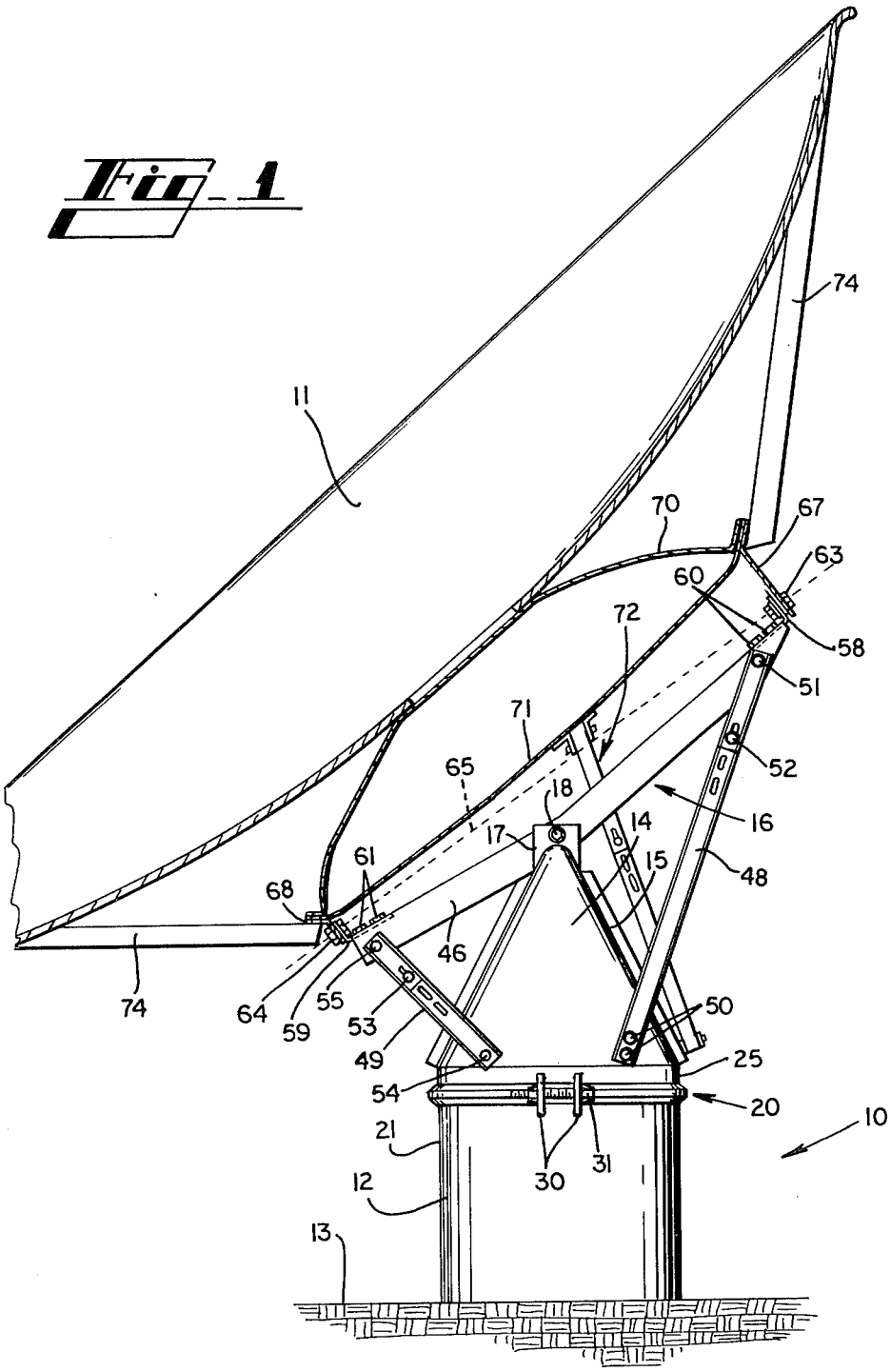
FIG. 1 is a side plan view of an antenna mounting structure embodying the present invention.

Referring now in more detail to the drawing, in which like numerals represent like parts throughout the several views, FIG. 1 shows an antenna mounting structure 10 of the polar type, embodying the present invention. An antenna reflector 11 is shown supported by the mounting structure 10. The construction of the antenna 11 and the electronics associated therewith form no part of the present invention, and therefore are not shown in detail. The mounting structure for the reflector 11 includes a base 12 securely anchored to the earth or a platform 13. Where convenient, the base 12 may be embedded in concrete. In the preferred embodiment shown, the base 12 comprises a cylinder of sheet metal. Strength and stability of the antenna mounting structure 10 is provided by the inherent resistance of the cylindrical shape to bending or tipping under the influence of the weight of the antenna or exterior forces such as wind. To provide greater strength and stability, it is only necessary to increase the diameter of the base 12. Positioned to rest upon the base 12 is a cupola 14 which preferably comprises sheet metal formed in the shape of a cone, although the support function of the cupola 14 can be provided by other structural shapes. As shown, the cupola 14 is assembled from two halves. Outwardly extending flanges 15 facilitate connection of the halves of the cupola 14 and lend rigidity to the cupola in the plane of the polar axis. The cupola carries a polar support assembly 16 which directly supports the reflector 11, and is described in detail hereinafter. The primary connection of the polar support assembly 16 to the cupola 14 is by way of a bracket 17 situated at the top of the cupola 14, and a bolt 18 which forms an elevation pivot for initial adjustment of the elevation of the reflector 11.

Figure 2:
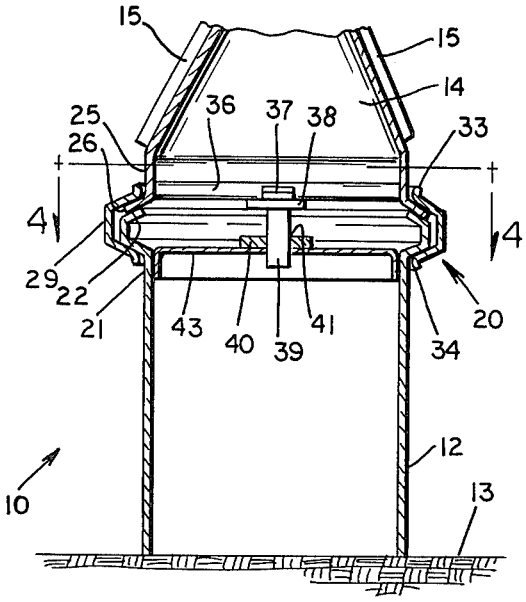
FIG. 2 is a partial vertical cross-sectional view of the antenna mounting structure shown in FIG. 1.
Figure 3:
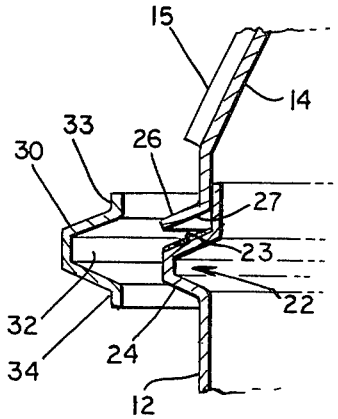
FIG. 3 is an exploded fragmentary cross-sectional view of a portion of the bearing apparatus of the antenna mounting structure shown in FIGS. 1 and 2.

The cupola 14 is joined to the base 12 by an azimuth bearing 20 shown in FIGS. 1, 2 and 3. The azimuth bearing 20 includes a base bearing projection 21 which extends upwardly and terminates in a circular radially outwardly extending base bearing flange 22. The base bearing projection 21 is, in the preferred embodiment, merely an extension of the cylinder of sheet metal forming the base 12. However, it will be understood that the general shape of the base could be other than cylindrical, in which case a distinct projection extending away from the base to define the base bearing flange might be necessary. The sheet metal of the base bearing projection 21 is formed into the base bearing flange 22 as shown in FIGS. 2 and 3. The flange 22 has a cross-sectional shape of an inwardly opening truncated "V". There are thus defined an upper flange-receiving surface 23 that slopes downwardly with increasing radius, and a lower coupling-receiving surface 24 that slopes upwardly with increasing radius.

The cupola 14 terminates in a downwardly extending cupola bearing projection 25 which defines at its end a circular radially outwardly extending cupola bearing flange 26. The lower surface of the flange 26 is a flange-engaging surface 27 which slopes downwardly with increasing radius and is supported by the mating flange-receiving surface 23 of the base bearing flange 22. If desired, a layer of lubricating material 28, such as grease or Teflon, may be applied to the base flange-receiving surface 23, as shown in FIG. 3, or to the cupola flange-engaging surface 27. It should be noted, however, that some degree of friction between such surfaces is desirable to promote stability of the cupola and antenna as they rest upon the base 12, so long as the cupola 14 and antenna can be rotated about the azimuth axis by the exertion of a reasonable manual force, when clamp 32 (described below) is loosened.

If desired, the base bearing flange 22 can be extended inwardly and upwardly, as shown in FIG. 3, to form a sleeve 35 to matingly receive the cupola 14. In some applications not requiring frequent rotation about the azimuth axis, the sleeve 35 provides lateral stability without adding the more detailed stabilizing means described below.

The cupola bearing flange 26 and the base bearing flange 22 are held together by a circular coupling 29 surrounding the flanges. The coupling has a cross-sectional shape of a truncated "V", and defines an inwardly opening annular recess 32 for receiving the flanges 22 and 26. The coupling 29 can be urged inwardly onto the engaged flanges to lock the flanges, and alternately released to allow relative movement thereof, by effectively contracting or expanding the circumference of the coupling. In the embodiment shown, this is done by providing at least one break in the circumference of the coupling 29, and outwardly extending clamping flanges 30 at the adjacent ends of the coupling 29. A bolt and nut assembly 31 passes through the flanges 30 and can be tightened or loosened to lock or unlock the bearing 20. The coupling 29 also preferably includes annular flanges 33 and 34 extending upwardly and downwardly, respectively, from the inward ends of the coupling 29. The flanges 33 and 34 provide strength and rigidity to the coupling 29.

Figure 4:
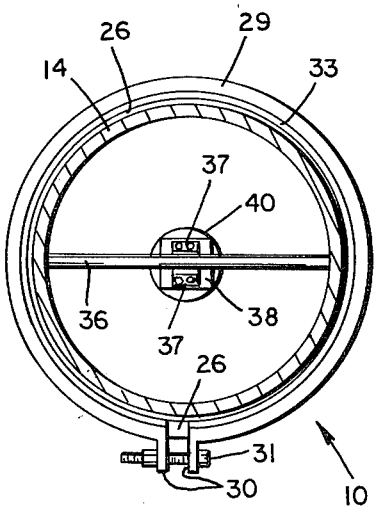
FIG. 4 is a horizontal cross-sectional view of the antenna mounting structure shown in FIGS. 1 and 2, taken along line 4—4 of FIG. 2, looking downwardly.

A brace 36, shown in FIGS. 2 and 4, extends across the throat of the cupola bearing projection 25 to strengthen the sheet metal cupola 14. A pair of brackets 37 suspend from the brace 36 a shaft support block 38 and a depending shaft 39 which extends axially from the center of the cupola bearing projection 25 downwardly beyond the height of the base bearing flange 22. The shaft 39 is preferably constructed of steel. The base 12 includes an aluminum plate 40 defining a bore 41 therein supported by a diaphram 43 which spans the base bearing projection 21. The bore 41 is positioned to receive the shaft 39, such that the shaft 39 and plate 40 assist in centering the cupola 14 with respect to the coaxial base 12. It should be understood, however, that the bearing 20 is operable without the location means provided by the shaft 39.

In operation of the bearing 20, the bolt and nut assembly 31 is loosened to permit relative rotation of the cupola 14 and base 12. The shaft 39 and plate 40 assist in maintaining alignment of the cupola and base during relative rotation. When the precise desired azimuth position of the cupola and antenna is reached, the bolt and nut assembly 31 is tightened. As the coupling 29 is thereby contracted radially inwardly, the action of the coupling 29 upon the flanges 22 and 29 is to compress the flanges axially against one another. Thus, the locking operation initially locks the flange against one another so that the desired azimuth orientation cannot change as a result of mechanical manipulation of the locking mechanism.

It will be understood that the bearing structure just described has applicability to many types of adjacent members that require a bearing for relative rotational movement. If such members can be provided with adjacent radially outwardly extending flanges around which can be placed a coupling having an inwardly opening recess for receiving and clamping the flanges, a bearing structure embodying the present invention can be provided. Thus, the broad concept of the present invention is not restricted to bearing structures for antenna mounting systems.

In the embodiment of the present invention shown in FIG. 1, the antenna mounting structure 10 includes a polar support assembly 16 supported by the cupola 14. A polar support beam 46 if formed from a downwardly opening channel section, and is pivotally supported intermediate its ends by the bolt 18 which passes through the bracket 17 of the cupola 14. The polar support beam 46 is stabilized and maintained in a particular orientation by four telescoping support braces, two of which are shown in FIG. 1. A pair of support braces 48 are affixed at their lower ends to the cupola 14 by bolts 50, and are affixed at their upper ends to the polar support beam 46 by bolts 51. The telescoping support braces 48 can comprise nesting channel sections that can be slid relative to one another to lengthen or shorten the length of the braces 48, and then locked by tightening a lock bolt 52, in a manner well known to those skilled in the art. A second pair of telescopic support braces 49 are attached at their lower ends to the cupola 14 by bolts 54 and to the polar support beam 46 at their upper ends by bolts 55. The braces 49 are similarly nesting channel sections that can be locked at the desired length by a lock bolt 53.

At the upper and lower ends of the polar support beam 46, "L" shaped brackets 58 and 59, respectively, are attached by bolts 60 and 61, respectively, to the support beam 46. One arm of each bracket is thus fixed to the support beam 46. The other arm of each bracket extends away from the cupola 14 and defines an opening therein (not shown) for receiving bolt and nut assemblies 63 and 64, respectively. The polar rotational axis provided by the polar support assembly 16 is defined by a line through the bolt and nut assemblies 63 and 64, and is shown as a dashed line 65 in FIG. 1.

Antenna support legs 67 and 68 are provided and define openings (not shown) adjacent to one end thereof. The legs 67 and 68 are positioned adjacent to the brackets 58 and 59 by passing the bolt assemblies 63 and 64 through the openings in the legs 67 and 68. At their opposite ends, the legs 67 and 68 are attached to a central antenna base 70 which is a dome-shaped structural member enclosed by a bottom member 71. The central antenna base 70 can be constructed of sheet metal. The antenna reflector 11 is generally constructed of panels (details of which are not shown) which are fixed at their inner ends to the central antenna base 70. A plurality of braces 74 extend from the outer circumference of the central antenna base 70 toward the periphery of the reflector 11. A telescoping member 72 connected to the side of the antenna base 70, and to the lower part of the cupola 14, provides a means for rotating the reflector 11 about the polar axis 65. The member 72 extends outside the braces 48 and provides an hour-angle actuator. The position at which the bolts 50 attach the lower ends of the braces 48 to the cupola 14 can be modified to permit a greater range of movement by the actuator 72.

Operation of the polar support assembly 16 requires an initial elevation adjustment and periodic adjustments about the polar axis 65. After the initial adjustment of the azimuth bearing 20, as described hereinabove, to place the polar axis 65 in the North-South plane, the telescoping support braces 48 and 49 are adjusted to place the polar axis 65 at the proper angle with respect to the horizon so that rotation of the antenna about the polar axis will intercept the positions of a series of geosynchronous satellites. The angle of elevation is typically approximately equal to the latitude at which the antenna is located. The lock bolts 52 and 53 are tightened to maintain the proper angle of elevation. In order to aim the antenna at a desired satellite or to change the aim of the antenna from one satellite to another, the bolt and nut assemblies 63 and 64 are loosened, and the antenna reflector is rotated about the polar axis 65 to the desired orientation by adjusting the length of the telescoping member 72. Then the bolts 63 and 64 are tightened to lock the antenna in position aiming at the desired satellite.

Figure 5:
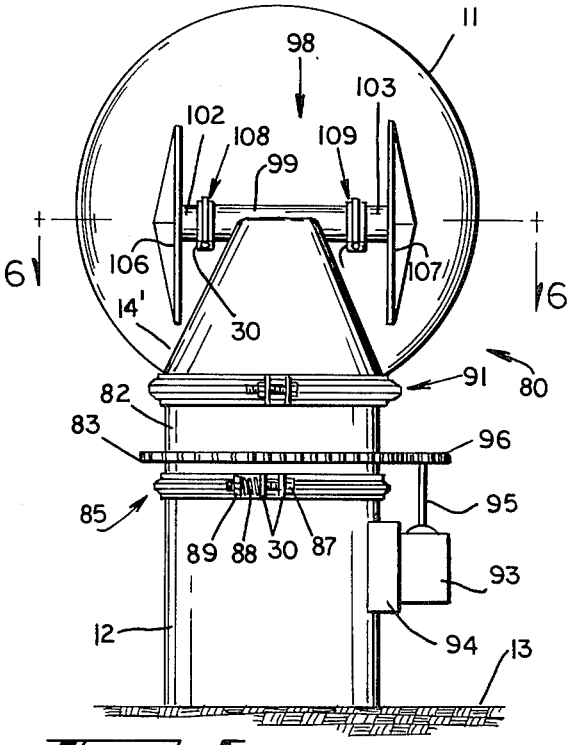
FIG. 5 is a rear plan view of an antenna mounting structure in a second embodiment of the present invention, showing use of the bearing apparatus of the invention in an elevation axis assembly.
Figure 6:
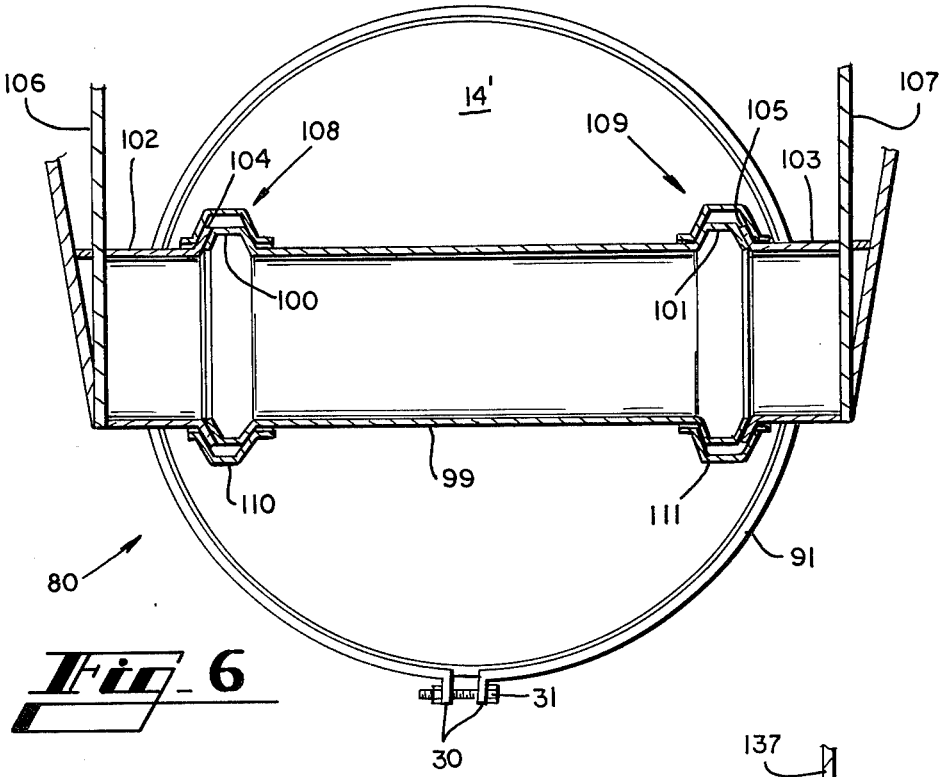
FIG. 6 is a horizontal cross-sectional view of the bearing apparatus of FIG. 5, taken along line 6—6 of FIG. 5, looking downwardly.

A second embodiment of the present invention in an antenna mounting structure 80 is shown in FIGS. 5 and 6. The structure 80 includes a cylindrical base 12 and a cupola 14' suitably shaped to support shaft 99. However, the structure 80 further includes a cylindrical drive section 82 which is mounted between the base 12 and cupola 14. The drive section 82 includes an annular rack gear 83 extending from the outer circumference of the drive section 82. The rack gear 83 can be integrally cast with the drive section 82 or can be attached thereto by a suitable means such as welding. The drive section 82 is connected to the base 12 by means of a bearing 85 constructed according to the invention, similar to the bearing 20 shown in FIG. 1. The bearing 85 includes a modified bolt assembly 87 for connecting the ends of the coupling of the bearing 85. The bolt assembly 87 extends through the clamping flanges 30, but includes a compression spring 88 between one of the clamping flanges and a retaining nut 89. The strength of the spring 88 is such that under normal conditions the coupling of the bearing 85 engages the flanges of the bearing with sufficient force to lock the drive section 82 and base 12 in desired relative positions. However, mechanical force applied to rotate the drive section 82 can overcome the force of the spring 88 without loosening the bolt assembly 87.

For convenience, the drive section 82 is provided with an upper bearing flange so that it can be connected to the cupola 14' by a bearing 91 that is identical to the bearing 20 shown in FIG. 1. The coupling of the bearing 91 is generally left in a tightened condition to lock the cupola 14' to the drive section 82 so that the cupola 14' and antenna reflector 11 will rotate with the drive section 82.

In order to provide a means to rotate the drive section 82 and the antenna, a motor 93 is mounted on the base 12 by means of a conventional motor mount 94. A drive shaft 95 of the motor 93 extends upwardly beyond the bearing 85 and has a pinion gear 96 mounted horizontally to the end of the drive shaft 95 in engagement with the rack gear 83. The motor 93 can be a conventional electric or hydraulic reversible or non-reversible motor, provided with conventional controls for causing the motor 93 to rotate the pinion gear 96 and therefore rotate the drive section 82 and antenna about the azimuth axis as desired. It will be further understood that a variable speed drive can be utilized to permit rotation of the antenna in very small increments.

The antenna mounting structure 80 of FIG. 5 also includes an elevation axis assembly 98. Support means for the elevation axis assembly 98 is provided by the base 12, the drive section 82, the cupola 14' and a horizontal cylindrical cross member 99 attached to the top of the cupola 14'. Bearing flanges 100 and 101 similar to the base bearing flange 22 of FIG. 2 are provided at the opposite ends of the cross piece 99, as shown in FIG. 6. Bearings 108 and 109 identical to the bearing 20 of FIG. 1 connect the cross piece 99 to an antenna support framework which includes frame bearing segments 102 and 103 which define bearing projections extending toward the cross piece 99 and terminate in bearing flanges 104 and 105. The flanges 104 and 105 engage the bearing flanges 100 and 101 of the cross piece 99. Annular couplings 110 and 111 receive and selectively lock the adjacent flanges 100 and 104, in the bearing 108, and adjacent flanges 101 and 105, in the bearing 109. Each coupling 108 and 109 includes clamping flanges 30 and a bolt and nut assembly for tightening the coupling similar to those described earlier in connection with the bearing 20.

In order to adjust the elevation of the antenna reflector 11, the bearings 108 and 109 are unlocked by loosening the couplings 110 and 111. The antenna is thereafter rotated about the elevation axis which passes through the centers of the bearings 108 and 109 until the desired orientation is obtained. Then, the couplings 110 and 111 are tightened to lock the antenna in its new orientation. It will be understood that mechanical means can be provided for remote changing of the orientation of the antenna about the elevation axis. Such mechanical means could be similar to the motor 93 and driving gears 83 and 96 described hereinabove for causing rotation about the azimuth axis. It will further be understood that a polar axis assembly could be constructed with a pair of bearing structures according to the invention in a manner similar to the elevation axis assembly 98.

Figure 7:
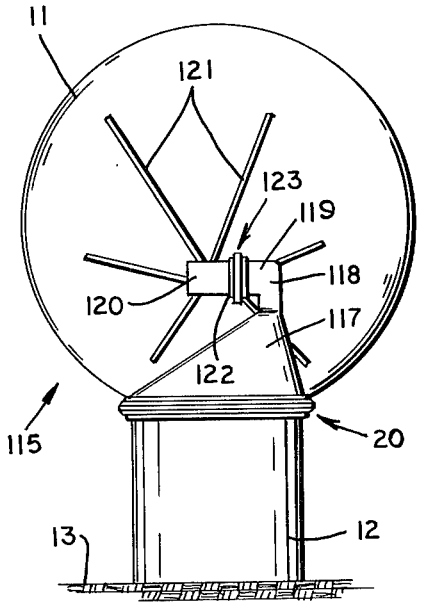
FIG. 7 is a rear plan view of a third embodiment of the present invention, in an antenna mounting system, showing an elevation axis assembly using a single bearing structure.

A third embodiment of the present invention in an antenna mounting structure 115 is shown in FIG. 7. In the third embodiment, a single bearing structure is utilized to provide an elevation axis. As shown in FIG. 7, the base 12 is connected by the bearing 20 to a specially constructed cupola 117 which includes a vertically extending neck 118 and a cupola bearing projection 119 which extends horizontally and defines at its end a bearing flange (not shown). An antenna support frame 120 is connected to the antenna reflector 11 by a plurality of braces 121. The support frame 120 includes a cylindrical bearing projection 122 which also defines a bearing flange that engages the bearing flange of the cupola projection 119 and is received by a coupling in a bearing structure 123 identical to the bearing 20, 108 and 109. Operation of the bearing 123 to pivot the reflector 11 about the elevation axis will be apparent from the description of previous embodiments.

Figure 8:
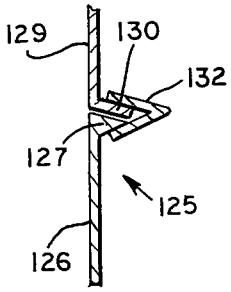
FIGS. 8–10 are fragmentary cross-sectional views showing alternate configurations of parts of the bearing apparatus according to the present invention.
Figure 9:
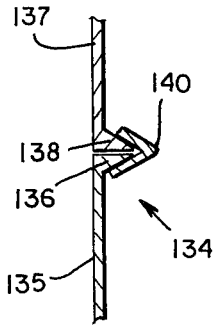
Figure 10:
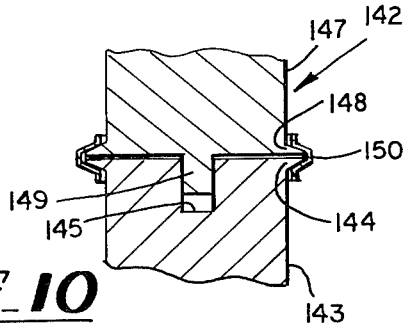

It will be evident from the foregoing description of the structure and operation of a bearing apparatus embodying the present invention that many configurations are possible for the bearing projections of adjacent members being connected by the bearing, and for the bearing flanges and couplings. A few of the possible configurations are shown in FIGS. 8, 9 and 10, which are fragmentary cross-sectional views. FIG. 8 shows a bearing structure 125 which includes a base 126 which defines a solid triangular bearing flange 127. An adjacent member or cupola 129 extends downwardly and defines a circular bearing flange 130 which engages the base bearing flange 127. A coupling 132 is provided having the shape of a simple "V", without reinforcing flanges or truncation of the point of the "V".

FIG. 9 shows another embodiment of a bearing structure 134 in which a base 135 defines a triangular base bearing flange 136 which has a horizontal flange engaging surface. A cupola 137 defines a cupola bearing flange 138 that is the mirror image of the base bearing flange 136. A coupling 140 receives and locks the flanges 136 and 138. In FIG. 10, the flange shapes shown in FIG. 9 are embodied in solid adjacent members, a base 143 and a cupola 147. The solid cylindrical base 143 defines an annular base bearing flange 144 having a flat horizontal upper surface extending across the base 143. The base 143 also defines an axial bore 145. The solid cylindrical cupola 147 defines a cupola bearing flange 148 having a flat horizontal lower surface. An integrally formed shaft projection 149 extends into the bore 145 to provide a function similar to that of the shaft 39 of the embodiment shown in FIG. 2. A coupling 150 surrounds and receives the bearing flanges 144 and 148.

It will be noted that the configurations shown in FIGS. 8, 9 and 10 each provide at least one bearing flange including a flange receiving surface and a coupling receiving surface which are angled with respect to one another so as to define a "V", the arms of which diverge toward the axis of rotation. Also, the coupling-receiving surfaces of the adjacent flanges are angled with respect to one another such that the inwardly opening annular recess of the coupling engages said surfaces, when the coupling is urged radially inwardly, in a manner which urges the adjacent flanges axially toward one another. These relationships also hold true for the preferred embodiment of the invention shown in FIGS. 2, 3 and 6.

From the foregoing, it will be seen that the present invention provides a strong, lightweight, inexpensive, lockable bearing apparatus for selectively permitting rotation between two adjacent members. The bearing structure according to the invention is particularly useful in providing axes of rotation in antenna mounting structures.

While the present invention has been described in detail with particular reference to preferred embodiments thereof, it will be understood that variations and modifications can be effected within the spirit and scope of the invention as described hereinbefore and as defined in the appended claims.

I claim:

1. In an antenna mounting structure, a bearing apparatus for permitting rotation of said antenna about an axis, comprising:

support means for supporting said antenna, said support means including a first circular bearing flange extending radially outwardly from an end portion of said support means;

a base member, stationary during rotation of said antenna about said axis, for suporting said support means, said base member including a second circular bearing flange extending radially outwardly from an end portion of said base member, said second bearing flange being positioned coaxially with and adjacent to said first bearing flange; and coupling means for clamping said first and second bearing flanges together, comprising an annular coupling member surrounding said first and second flanges, said coupling member defining an annular inwardly opening recess therein for receiving said flanges.

2. The apparatus of claim 1, further comprising means for expanding or contracting the circumference of said coupling means to adjust the force of said coupling means upon said flanges.

3. The apparatus of claim 1, further comprising means for selectively rotating said support means about said axis.

4. The apparatus of claim 3, wherein said coupling means includes biasing means for applying a predetermined tension to clamp said first and second bearing flanges together, said predetermined tension being selectively overcome by said means for rotating said support means.

5. The apparatus of claim 3, wherein said means for rotating said support means comprises a circular rack gear surrounding and fixed to said support means; a pinion gear engaging said rack gear; and means for rotating said pinion gear.

6. The apparatus of claim 1, wherein said axis is vertical, and wherein said base member comprises an upstanding cylinder anchored to the ground at the end thereof opposite said second bearing flange.

7. The apparatus of claim 6, wherein said cylinder comprises sheet-like material; and wherein said second bearing flange comprises said material of said cylinder formed into an outwardly projecting annular member.

8. The apparatus of claim 1, wherein said coupling means selectively engages said flanges so as to compress said flanges axially against one another.

9. The apparatus of claim 1, further comprising:

a shaft mounted to extend axially from the center of said first bearing flange toward said base member; and a shaft-receiving member mounted at the center of said second bearing flange and defining therein an axial bore positioned to matingly receive said shaft.

10. The apparatus of claim 1, wherein said axis is horizontal and wherein:

said support means comprises a pair of said first circular bearing flanges positioned coaxially along said axis in spaced apart relation facing one another;

said base member comprises a cross member extending between said first bearing flanges and including a pair of said second circular bearing flanges positioned at opposite ends of said cross member coaxially with and adjacent to said first bearing flanges; and a pair of said coupling means clamp each of said pairs of first and second bearing flanges together.

11. The apparatus of claim 1, wherein said axis comprises an azimuth axis, and wherein said antenna mounting structure further comprises an elevation bearing means for permitting rotation of said antenna about an elevation axis.

12. The apparatus of claim 1, wherein said axis comprises an elevation axis, and wherein said antenna mounting structure further comprises an azimuth bearing means for permitting rotation of said antenna about an azimuth axis.

* * * * *